US006874402B2

(12) United States Patent
Ettmueller

(10) Patent No.: US 6,874,402 B2
(45) Date of Patent: Apr. 5, 2005

(54) PROJECTILE AND METHOD FOR PRODUCING IT

(75) Inventor: Peter Ettmueller, Bachenbülach (CH)

(73) Assignee: Oerlikon Contraves Pyrotec AG, Zurich (CH)

( * ) Notice: Subject to any disclaimer, the term of this patent is extended or adjusted under 35 U.S.C. 154(b) by 0 days.

(21) Appl. No.: 10/093,262

(22) Filed: Mar. 6, 2002

(65) Prior Publication Data

US 2002/0129727 A1 Sep. 19, 2002

(30) Foreign Application Priority Data

Mar. 14, 2001 (CH) ..... 0472/01

(51) Int. Cl.[7] ..... B21K 21/06; F42B 30/08; F42C 13/00; F23Q 21/00

(52) U.S. Cl. ..... 86/53; 86/55; 86/51; 89/6; 102/213; 102/214; 102/215

(58) Field of Search ..... 102/211–215, 270, 102/271; 86/51–56; 89/6, 6.5

(56) References Cited

U.S. PATENT DOCUMENTS 4,750,424 A * 6/1988 Hau ..... 102/200
5,014,062 A * 5/1991 Schriner et al. ..... 102/214
5,117,732 A * 6/1992 Munzel et al. ..... 89/6.5
5,343,795 A * 9/1994 Ziemba et al. ..... 89/6.5

* cited by examiner

*Primary Examiner*—Michael J. Carone
*Assistant Examiner*—James S. Bergin
(74) *Attorney, Agent, or Firm*—McCormick, Paulding & Huber LLP

(57) ABSTRACT

A projectile, having a casing, a projectile base, which closes the casing off at the rear, a receiver coil for receiving electromagnetic signals, an energy source which is put into contact with the receiver coil, and a logic module. The casing is made from a plastic material, at least in the area of the rear.

4 Claims, 1 Drawing Sheet

10.1

10.2

10.3

PROJECTILE AND METHOD FOR PRODUCING IT

CROSS REFERENCE TO RELATED APPLICATIONS

This application claims priority from and incorporates by reference the subject matter of Swiss Patent Application No. 2001 0472/01 filed on Mar. 14, 2001.

FIELD OF THE INVENTION

The invention relates to a projectile and to a method for producing it.

BACKGROUND OF THE INVENTION

Projectiles of this type are intended to disintegrate in flight, or to detonate, and are also called "air bursting munitions", abbreviated as ABM. Projectiles which detonate in flight have a timed fuse, revolution fuse or proximity fuse. The location or the time of detonation should be selectable, or adjustable. With more recent projectiles the setting of the time of detonation, or the length of the fuse, is no longer manually performed prior to loading, but automatically, either during feeding, or in the cartridge storage, or by an inductive signal transmission at the muzzle of the weapon upon firing. The projectiles have special devices for receiving the signals and, via an energy source, for operating a logical ignition device and for delivering the electrical energy required in the projectile for triggering the detonation.

The demands made on such projectiles are numerous.

For one, the effective mass delivered to the location of the detonation should be as large as possible for obtaining a satisfactory effect, and the projectile pieces being created by the detonation should have the greatest possible velocity. Inter alia, this requires a high drive pressure on the projectile base, which must be made sturdy, a large axial acceleration and a high muzzle velocity, so that the speed of rotation and the acceleration of the rotation are also high. The programmable device with the energy source and the logic module must operate dependably and correctly.

Furthermore, the non-effective mass, part of which are the programmable device, in particular the receiver coil, the energy source and the logic module, must be as small as possible. Therefore the programmable device has delicate and easily damaged elements, which must be well protected so that they can withstand the large forces caused by the acceleration.

Finally, it should be possible to manufacture the projectile efficiently, if possible from units which can be individually manufactured and are produced in parallel and can thereafter be put together in a simple manner. Therefore a modular construction is desired.

So far no projectiles of the type mentioned at the outset are known which meet all these requirements.

OBJECT AND SUMMARY OF THE INVENTION

Thus, it is the object of the invention to improve a projectile of the type mentioned at the outset in such a way that the disadvantages of known projectiles are removed, and to propose a method for producing this projectile.

The object is attained in accordance with the invention in connection with the projectile having a casing, a projectile base, a receiver coil, an energy source and logic module by making the casing of a plastic material at least in the area of the rear, and in connection with the method of producing the projectile by making the casing from a plastic material, connecting the casing with the projectile base, producing the receiver coil from a winding on a coil body independently of making and connecting the casing with the projectile base, and subsequently mounting the receiver and the energy source and the logic module as a single component in the casing.

Advantageous further developments of the projectile and the method producing the projectile in accordance with the invention are also described hereafter.

In accordance with the invention, the novel projectile has a casing which is made of a plastic material, at least in the rear area of the projectile. Because of this the non-effective mass of the projectile is less than that of a projectile with a metallic casing, and surface treatments which are required in connection with customary metallic casings are omitted.

The shaping of the plastic material can take place by means of a machining or a non-cutting process.

The shaping of the plastic material for the casing preferably takes place by means of a non-cutting process, such as pressure or injection molding. Such processes are efficient, in particular in connection with larger numbers of pieces such as are customary in the production of projectiles, because in this case the costs of the mold are for all practical purposes unimportant.

In the process it is particularly advantageous to perform the mutual connection of the casing with the projectile base which, for reasons of sturdiness, is generally metallic, simultaneously with the non-cutting shaping of the casing, wherein the projectile base is inserted into the injection mold used for producing the plastic part, and the plastic material is injected around it.

By means of an optimal design of the casing it is possible to create a rotating band part, or a rotating band integrally formed on the rear area of the casing, in place of a separate rotating band.

A receiver coil is arranged for receiving external signals. Since it is necessary to protect it against pressure effects, it is advantageously arranged in the interior of the projectile, not on the circumference of the projectile. This requires that the plastic material from which the casing is made does not have a shielding effect against electromagnetic waves, or signals, at least in the area of the receiver coil. Because of the arrangement of the receiver coil in the interior instead of on the exterior of the casing, the provision of an elaborate protective winding, such as is provided for a customary receiver coil arranged on the exterior of the casing, becomes superfluous. It is prevented, even better than with a protective winding, that the conductors constituting the receiver coil are deformed. By means of this, interference with the signals to be received because of the deformation of the conductors is prevented and the risk of short circuits is reduced. Moreover, the risk of a penetration by moisture is practically eliminated. It is furthermore essential that, because of the short distance of the receiver coil from the longitudinal axis of the projectile, the rotational acceleration, and therefore the forces acting on the receiver coil, are reduced.

It has been proven to be advantageous to apply the winding of the receiver coil on a separate coil body. Because of this the receiver coil can be produced as a unit, and can thereafter be assembled together with the energy source and the logic module.

The required energy can be externally generated and transmitted to the projectile. However, it is advantageous to provide an internal energy source, for example by means of a surge generator, because it is independent from the weapons system.

In order to provide the conductive connection between the energy source, the logic module and the receiver coil in a simple manner, it is advantageous to arrange the receiver coil next to the energy source and the logic module.

Such a design of the novel projectile, in accordance with which the energy source and the logic module are arranged adjacent to the receiver coil, allows the provision of the conductive connection between the receiver coil, the energy source and the logic module in a simple way. Work steps which cannot be automated and are therefore cost-intensive, such as the insertion of the conductive connection into a narrow passage, which are necessary with receiver coils located at the exterior, are omitted.

A particularly advantageous projectile in accordance with the invention is embodied in such a way that its effective mass, in particular the explosives, and possibly effective bodies, is arranged in the front portion of the projectile. A good effect is achieved by means of this, which will be explained in what follows: following the detonation, the velocity vectors of the effective bodies being created are added to the velocity of the projectile, and the sum of the velocities is on the average of all pieces created greater than with projectiles with an effective mass arranged toward the front. It is moreover possible, for example in house-to-house fighting, to achieve an increase in the target surface by means of the detonation of the projectile before reaching the target, which is considerable in comparison with customary munitions or ABM with fuses in the head.

In the course of producing the novel projectile, several components are separately produced and only put together later. This has three essential advantages: firstly, stock-keeping and manufacture are more flexible, secondly, shorter processing times as a whole are possible during manufacture, because it is possible to work parallel on the individual components, thirdly, no delicate components are already stressed, or even damaged, before their use because of subsequent production operations.

Details and advantages of the invention will be extensively described in what follows by means of an exemplary embodiment and by making reference to the drawings.

DETAILED DESCRIPTION OF THE PREFERRED EMBODIMENTS

Figure 1:
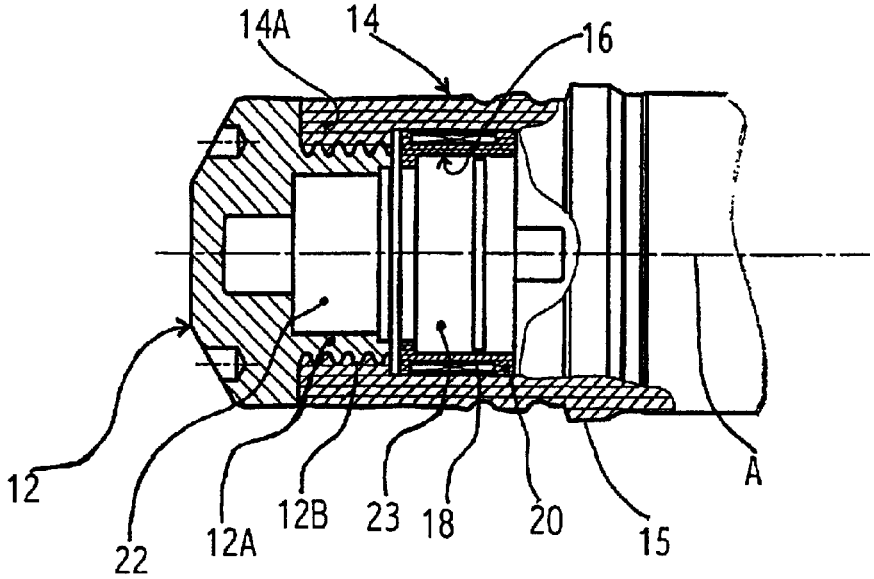
FIG. 1 shows a first exemplary embodiment of the projectile in accordance with the invention in a sectional view containing the longitudinal projectile axis.

The projectile 10.1 with the longitudinal projectile axis A represented in FIG. 1 has a projectile base 12 made of a suitable metal and a casing 14 which is made of a suitable plastic material, at least in the rear area, but preferably as a whole. The casing 14 has been produced by means of a pressure or injection molding process, but could alternatively also be shaped by a machining process. The connection of the casing 14 with the projectile base 12 can take place simultaneously with the production of the casing. To provide a secure connection between the projectile base and the casing 14, the projectile base 12 has grooves 12*b* on the exterior of its base area 12A, which project forward, and is essentially hollow-cylindrical. The material of the casing 14 has been injected around the grooves 12*b*, so that the forward projecting base area 12A is connected with a casing area 14A projecting toward the rear.

It is also possible to fasten the projectile base 12 and the casing 14 to each other by means of another suitable connection, for example screwing, welding, gluing or by a plug connection, such as will be described further down in connection with FIG. 2.

The plastic material used for producing the casing 14 can contain fillers, but at least in the area of the receiver coil must consist of a material which does not provide shielding against electromagnetic waves, or signals. Other materials, which do not have shielding effects against electromagnetic waves, or signals, are also possible in place of plastic, for example ceramic materials or glass.

An integral rotating band 15 has been formed on the exterior contour of the casing 14. Thus, the production and assembly of a separate, for example metallic rotating band is omitted.

A receiver coil 16 as a component of a programmable device is arranged centered in the area of the projectile axis A, and its winding 18 has been applied to a coil body 20, preferably made of a plastic material.

The receiver coil 16 is conductingly connected with an energy source, or energy storage unit 22, and a logic module 23. For making the conductive connection between the receiver coil 16, the energy source, or energy storage unit 22, and the logic module 23 it is not necessary to pass a conductor through a narrow bore, as in conventional projectiles, instead, because of the centered arrangement of the receiver coil 16, as well as the energy source, or energy storage unit 22, and the logic module 23, the connection can be provided in a simple manner. For example, the conductive connection, including the actual contact, can take place by soldering. In another variation, an inserted intermediate element can be used, wherein contact is provided by means of a conductive adhesive. Contact merely by pressure is particularly simple to provide, but less secure. A plug connection is elaborate in the production of the individual elements, however, it assures great dependability and is simple to assemble.

The above described projectile 10.1 is produced as follows: the casing 14 is created by injection molding, in the process the plastic material of the casing 14, or of the rear, is sprayed around the projectile base 12. Subsequently the energy source, or energy storage unit 22, the logic module 23 and the receiver coil 16 are inserted from the front.

Figure 2:
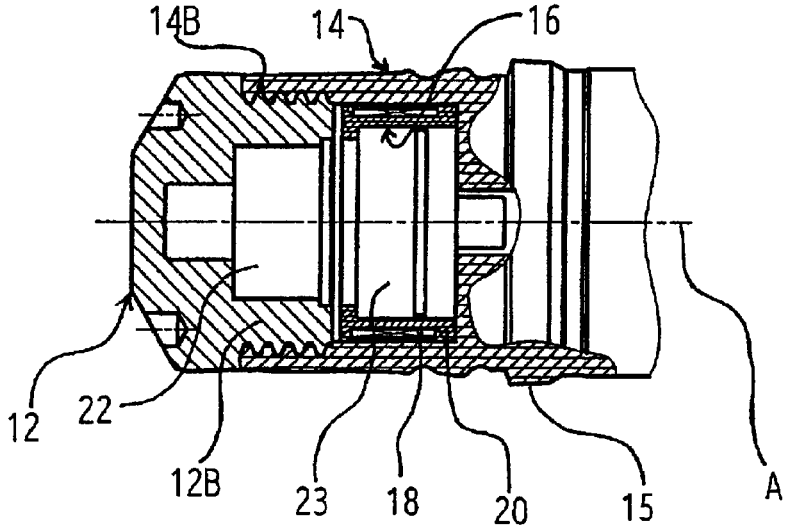
FIG. 2 shows a second exemplary embodiment of the projectile in accordance with the invention in the same representation as in FIG. 1.

FIG. 2 shows a further projectile 10.2 in accordance with the invention. The projectile 10.2 differs only negligibly from the projectile 10.1, therefore only the details differing from FIG. 1 will be described in what follows, and the same reference symbols as in FIG. 1 will be used for the individual structural elements in FIG. 2, and further down also in FIG. 3. In contrast to the projectile 10.1, the interior diameter of the rearward projecting casing area 14A of the projectile 10.2 is greater than the exterior diameter of the coil 16.

The manufacture of the projectile 10.2 takes place as follows: the casing 14, or the rear, is produced by a non-cutting process or by machining, wherein the rearward projecting casing area 14A is provided with an interior screw thread 14B. The forward projecting base area 12A of the projectile base is not provided with the ribs 12A, but with an exterior screw thread 12B complementary to the interior screw thread 14B. The receiver coil 16, the energy source, or the energy storage unit 22, and the logic module 23 are individually manufactured, fastened on the projectile base 12 and put in contact with each other. The component being created in the course of this is finally inserted from the rear into the casing 14, wherein the connection between the projectile base 12 and the casing 14 is provided by screwing the exterior screw thread 12*b* into the interior screw thread 14B.

Figure 3:
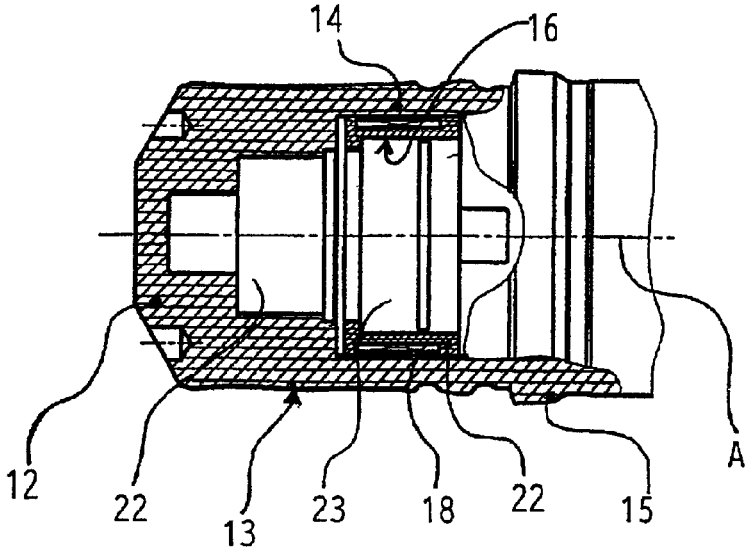
FIG. 3 shows a third exemplary embodiment of the projectile in accordance with the invention in the same representation as in FIGS. 1 and 2.

A third projectile 10.3 is represented in FIG. 3. With the projectile 10.3 the same material is used for the projectile base 12 as for the casing 14, in this case the projectile base 12 and the casing 14 are integrally produced in a pressure or injection molding process in the form of a pressure- or injection-molded element 13. The manufacture of the receiver coil 16, the energy source, or the energy storage unit 22, and the logic module 23 takes place separately, subsequently these three parts of the projectile 10.3 are combined into a component in the same way as described in regard to the projectile 10.1 in FIG. 1, and this component is mounted from the front in the pressure- or injection-molded element 13.

The receiver coil 16, the energy source, or the energy storage unit 22, and the logic module 23 are arranged in the rear projectile area of all three projectiles 10.1, 10.2, 10.3, so that the front area is free for receiving an effective mass, not represented.

What is claimed is:

1. A method for producing a projectile comprising:

a elastic casing having a rear, a projectile base, which closes off the plastic casing at the rear, a receiver coil for receiving signals, an energy source, brought into contact with the receiver coil, and a logic module, wherein at least one of the receiver coil and the energy source and the logic module are arranged in the vicinity of the longitudinal projectile axis a rear area of the projectile, and wherein the method of producing the projectile comprises the steps of:

producing the projectile base, making the casing from a plastic material, connecting the plastic casing with the projectile base, producing the receiver coil by creating a winding on a coil body and creating the energy source and the logic module independently of the production of the projectile base and the connection of the plastic casing with the projectile base, and mounting the receiver coil, the energy source and the logic module to the connected plastic casing and the projectile base in the rear area of the projectile.

2. The method in accordance with claim 1, wherein the plastic casing is produced by non-cutting shaping and is connected with the projectile base during the non-cutting shaping.

3. The method in accordance with claim 2, wherein the plastic casing and the projectile base are made from the same plastic material as an integral pressure- or injection-molded element.

4. A method for producing a projectile comprising:

a plastic casing having a rear, a projectile base, which closes off the plastic casing at the rear, a receiver coil for receiving signals, and an energy source, brought into contact with the receiver coil, and a logic module, wherein at least one of the receiver coil and the energy source and the logic module are arranged in the vicinity of the longitudinal projectile axis a rear area of the projectile, and wherein the method for producing the projectile comprising the steps of:

producing the plastic casing, producing the projectile base, mounting the plastic casing to the projectile base, forming one component by putting together the receiver coil, the energy source and the logic module, and mounting the one component to the connected plastic casing and projectile base.

* * * * *

UNITED STATES PATENT AND TRADEMARK OFFICE

CERTIFICATE OF CORRECTION

PATENT NO. : 6,874,402 B2
DATED : April 5, 2005
INVENTOR(S) : Peter Ettmueller

It is certified that error appears in the above-identified patent and that said Letters Patent is hereby corrected as shown below:

Column 5,
Line 40, after the word “axis”, please insert -- in --.

Column 6,
Line 32, after the word “axis”, please insert -- in --.

Signed and Sealed this

Twelfth Day of July, 2005

JON W. DUDAS
*Director of the United States Patent and Trademark Office*